US012121135B2

(12) United States Patent
Koike

(10) Patent No.: US 12,121,135 B2
(45) Date of Patent: Oct. 22, 2024

(54) BACKPACK-TYPE ASSEMBLY

(71) Applicant: MAKITA CORPORATION, Anjo (JP)

(72) Inventor: Yoichiro Koike, Anjo (JP)

(73) Assignee: MAKITA CORPORATION, Anjo (JP)

( * ) Notice: Subject to any disclaimer, the term of this patent is extended or adjusted under 35 U.S.C. 154(b) by 139 days.

(21) Appl. No.: 17/954,772

(22) Filed: Sep. 28, 2022

(65) Prior Publication Data

US 2023/0110242 A1 Apr. 13, 2023

(30) Foreign Application Priority Data

Oct. 7, 2021 (JP) ..... 2021-165540

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01); *A45F 2003/045* (2013.01)

(58) Field of Classification Search
CPC ..... A45F 2003/125; A45F 2003/122; A45F 3/04; A45F 2003/045; A45F 2003/127; A45F 3/12; F42F 2221/38; F04D 25/08; A41D 13/005
See application file for complete search history.

(56) References Cited

U.S. PATENT DOCUMENTS

| | | | | |
|---|---|---|---|---|
| 6,702,167 | B2 * | 3/2004 | Annis | A61M 1/06 604/35 |
| 8,225,974 | B2 * | 7/2012 | Zheng | A45F 3/08 224/628 |
| 9,851,113 | B2 * | 12/2017 | Clemente | A41D 13/0056 |
| 10,064,476 | B2 * | 9/2018 | Vierthaler | A45F 3/10 |
| 10,499,722 | B2 * | 12/2019 | Squires | A45F 3/04 |
| 10,555,594 | B2 | 2/2020 | Tai et al. | |
| 10,892,449 | B2 * | 1/2021 | Yamaoka | A45F 3/10 |
| 11,793,377 | B2 * | 10/2023 | Tahara | A47L 9/122 |
| 2005/0017041 | A1 * | 1/2005 | Roberts | A45F 3/04 224/642 |

(Continued)

FOREIGN PATENT DOCUMENTS

| | | | |
|---|---|---|---|
| CN | 201319950 Y | * | 10/2009 |
| JP | 2021-109303 A | | 8/2021 |

(Continued)

OTHER PUBLICATIONS

CN-201319950-Y with translation (Year: 2009).*

(Continued)

*Primary Examiner* — Adam J Waggenspack
(74) *Attorney, Agent, or Firm* — Oliff PLC

(57) ABSTRACT

A backpack-type assembly may include: a body; and a base member including a cooling port. The base member may include: a back plate attached to the body; and a harness attached to the back plate and configured to be worn on a user. The harness may include: at least one shoulder belt configured to be worn on a shoulder of the user; and a cooling fan. The cooling fan may be configured to circulate cooling air into or out of the base member through the cooling port of the base member.

17 Claims, 11 Drawing Sheets

(56) References Cited

U.S. PATENT DOCUMENTS

| | | | | |
|---|---|---|---|---|
| 2012/0286718 | A1* | 11/2012 | Richards | H02J 7/0044 320/103 |
| 2018/0146807 | A1* | 5/2018 | Silver | A47G 9/1045 |
| 2019/0226702 | A1* | 7/2019 | Nolan | F24F 11/0001 |
| 2019/0231054 | A1* | 8/2019 | Walter | A01K 97/125 |
| 2020/0196737 | A1* | 6/2020 | Chan | A45F 3/12 |
| 2021/0267357 | A1* | 9/2021 | Steffen | B25F 5/00 |

FOREIGN PATENT DOCUMENTS

| | | | | | |
|---|---|---|---|---|---|
| KR | 20100006694 | U | * | 7/2010 | |
| KR | 102533422 | B1 | * | 5/2023 | |
| WO | WO-2018034766 | A1 | * | 2/2018 | |
| WO | WO-2020147474 | A1 | * | 7/2020 | F04D 25/0673 |

OTHER PUBLICATIONS

KR-102533422-B1 with translation (Year: 2023).*
WO-2018034766-A1 with translation (Year: 2018).*
WO-2020147474-A1 with translation (Year: 2020).*
Apr. 15, 2024 Office Action issued in U.S. Appl. No. 17/954,538.

* cited by examiner

BACKPACK-TYPE ASSEMBLY

CROSS-REFERENCE TO RELATED APPLICATION

This application claims priority to Japanese Patent Application No. 2021-165540, filed on Oct. 7, 2021, the entire contents of which are hereby incorporated by reference into the present application.

TECHNICAL FIELD

The disclosure herewith relates to a backpack-type assembly.

BACKGROUND

Japanese Patent Application Publication No. 2021-109303 describes a backpack-type assembly. The backpack-type assembly includes a body and a base member. The base member includes a back plate attached to the body, and a harness attached to the back plate and configured to be worn on a user. The harness includes at least one shoulder belt configured to be worn on a shoulder of the user.

SUMMARY

When the user wears the backpack-type assembly as above on his/her back, heat may build up at a portion of the base member where it contacts the user's body, and the user might therefore feel hot. The description herein discloses an art for avoiding a situation in which a user feels heat while the user is wearing a backpack-type assembly on his/her back.

A backpack-type assembly disclosed herein may comprise: a body; and a base member including a cooling port. The base member may comprise: a back plate attached to the body; and a harness attached to the back plate and configured to be worn on a user. The harness may comprise: at least one shoulder belt configured to be worn on a shoulder of the user; and a cooling fan. The cooling fan may be configured to circulate cooling air into or out of the base member through the cooling port of the base member.

According to the above configuration, the user's body can be cooled by operating the cooling fan while the user is wearing the backpack-type assembly. Due to this, an occurrence of a situation in which the user feels heat while the user is wearing the backpack-type assembly on his/her back can be suppressed.

DETAILED DESCRIPTION

Figure 1:
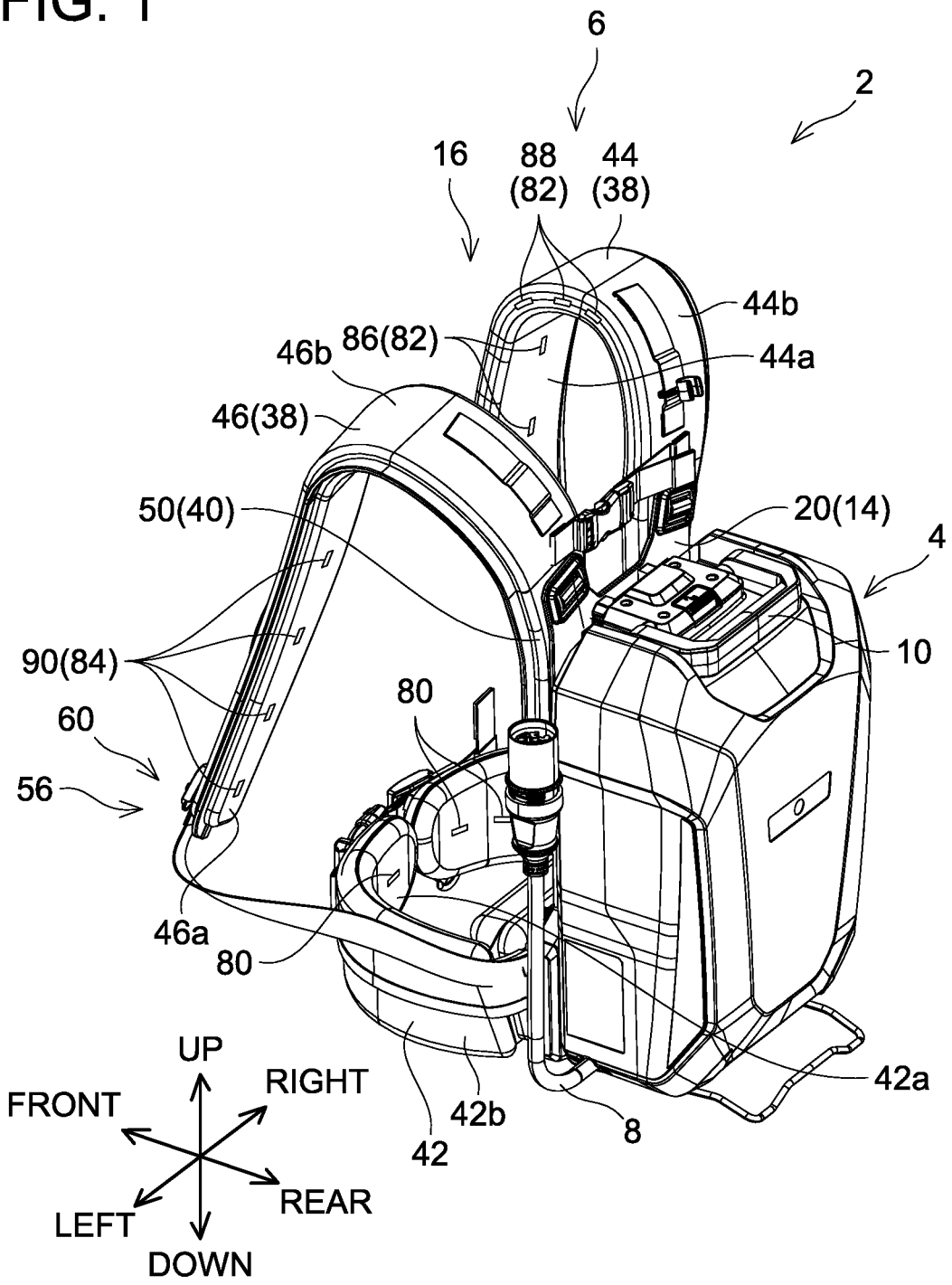
FIG. 1 is a perspective view of a backpack-type assembly 2 of a first embodiment.

Representative, non-limiting examples of the present disclosure will now be described in further detail with reference to the attached drawings. This detailed description is merely intended to teach a person of skill in the art further details for practicing preferred aspects of the present teachings and is not intended to limit the scope of the present disclosure. Furthermore, each of the additional features and teachings disclosed below may be utilized separately or in conjunction with other features and teachings to provide improved backpack-type assemblies, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, the cooling port may be disposed in vicinity of the user when the user wears the harness.

According to the above configuration, when the cooling air circulates through the cooling port, the cooling air flows in the vicinity of the user's body. Due to this, an occurrence of a situation in which the user feels heat while the user is wearing the backpack-type assembly on his/her back can be suppressed.

In one or more embodiments, the cooling port may face the user when the user wears the harness.

According to the above configuration, when the cooling air circulates through the cooling port, the cooling air flows along user's body surface. Due to this, the occurrence of the situation in which the user feels heat while the user is wearing the backpack-type assembly on his/her back can be suppressed.

In one or more embodiments, the harness may further comprise a back pad configured to be in contact with a back of the user when the user wears the harness. The cooling port may face a portion of the back of the user being in contact with the back pad when the user wears the harness.

When the harness has the back pad, the back pad comes into contact with the user's back. Due to this, heat may easily build up on the user's back. According to the above configuration, when the cooling air circulates through the cooling port, the cooling air flows along a surface of a part of the user's back that is in contact with the back pad. Due to this, the occurrence of the situation in which the user feels heat while the user is wearing the backpack-type assembly on his/her back can further be suppressed.

In one or more embodiments, the harness may further comprise a back pad configured to be in contact with a back of the user when the user wears the harness. A non-contacting space may be defined between the back of the user and the back plate when the user wears the harness, the non-contacting space being a space in which the back pad is not disposed. The cooling port may face the non-contacting space when the user wears the harness.

When the harness has the back pad, the back pad comes into contact with the user's back. Due to this, heat may easily build up on the user's back. According to the above configuration, when the cooling air circulates through the cooling port, the cooling air flows along the surface of the user's back in the non-contacting space. Due to this, the occurrence of the situation in which the user feels heat while the user is wearing the backpack-type assembly on his/her back can further be suppressed.

In one or more embodiments, the cooling port may be disposed on the shoulder belt.

Since the shoulder belt comes into contact with the user's shoulder when the user wears the backpack-type assembly on his/her back, heat may easily build up on the user's shoulder. According to the above configuration, when the cooling air circulates through the cooling port, the cooling air flows along a surface of the user's shoulder. Due to this, the occurrence of the situation in which the user feels heat while the user is wearing the backpack-type assembly on his/her back can further be suppressed.

In one or more embodiments, the harness may further comprise a waist belt configured to be worn on a waist of the user. The cooling port may be disposed on the waist belt.

When the harness has the waist belt, the waist belt comes into contact with the user's waist. Due to this, heat may easily build up on the user's waist. According to the above configuration, when the cooling air circulates through the cooling port, the cooling air flows along a surface of the user's waist. Due to this, the occurrence of the situation in which the user feels heat while the user is wearing the backpack-type assembly on his/her back can further be suppressed.

In one or more embodiments, the cooling fan may be disposed on the waist belt.

According to the above configuration, the cooling fan can be disposed without arranging a separate member for disposing the cooling fan on the base member.

In one or more embodiments, the cooling fan may be disposed on the shoulder belt.

According to the above configuration, the cooling fan can be disposed without arranging a separate member for disposing the cooling fan on the base member.

In one or more embodiments, the cooling fan may be disposed on the back plate.

According to the above configuration, the cooling fan can be disposed without arranging a separate member for disposing the cooling fan on the base member.

In one or more embodiments, the backpack-type assembly may further comprise an external power supply configured to supply electrical power to the cooling fan.

According to the above configuration, the cooling fan can be operated even when electrical power is not supplied from the body to the cooling fan.

In one or more embodiments, the base member may comprise an attachment configured to detachably attach the external power supply detachably.

According to the above configuration, the user can carry the external power supply by wearing the backpack-type assembly on his/her back.

In one or more embodiments, the body may be configured to be electrically connected to the cooling fan and be configured to supply electrical power to the cooling fan.

According to the above configuration, the cooling fan can be operated even when the backpack-type assembly does not have an external power supply for supplying electrical power to the cooling fan.

In one or more embodiments, the cooling fan may be configured so that a flow rate of the cooling fan is adjustable.

According to the above configuration, the flow rate of the cooling fan can be adjusted in accordance with a degree of heat which the user feels.

In one or more embodiments, the body may be configured to be connected to an electrical working machine comprising a motor. The body may be configured to supply electrical power to the motor of the electrical working machine.

According to the above configuration, the situation in which the user feels heat while the user is wearing the backpack-type assembly which supplies electrical power to the electrical working machine can be suppressed.

In one or more embodiments, the harness may comprise an air passage communicating with the cooling port. Cooling air may flow in the air passage when the cooling fan operates.

According to the above configuration, the harness can be cooled by the cooling air flowing to the air passage. Due to this, the occurrence of the situation in which the user feels heat while the user is wearing the backpack-type assembly on his/her back can be suppressed.

First Embodiment

A backpack-type assembly 2 of an embodiment will be described with reference to FIGS. 1 to 5. The backpack-type assembly 2 is used by being worn on a user's back. Hereinbelow, a direction that perpendicularly intersects the user's back when the backpack-type assembly 2 is worn by the user will be termed a front-rear direction, a direction that perpendicularly intersects the front-rear direction will be termed an up-down direction, and a direction that perpendicularly intersects the front-rear and up-down directions will be termed a left-right direction.

As shown in FIG. 1, the backpack-type assembly 2 comprises a body 4 and abase member 6. The body 4 is detachably attached to the base member 6. In the present embodiment, the body 4 is a large-sized, backpack-type power supply device. The body 4 may for example be 5 to 10 kg. The body 4 may for example include rechargeable secondary batteries. Electrical power can be supplied from an external charging source to the body 4 through a power supply (not shown) connected to the body 4. The body 4 is configured to be connected via a connection cable 8 to an electrical working machine (not shown) having a motor, and is configured to supply electrical power discharge to the motor. The user can wear the backpack-type assembly 2 on his/her back and work while holding the electrical working machine by hands. By using the backpack-type assembly 2, the user can use the electrical working machine over a long period of time.

A handle 10 is rotatably arranged at an upper portion of the body 4. In a state where the user is not wearing the backpack-type assembly 2 on his/her back, the handle 10 can be gripped by the user. The user can easily carry the body 4 by gripping the handle 10 and detaching the body 4 from the base member 6.

Figure 2:
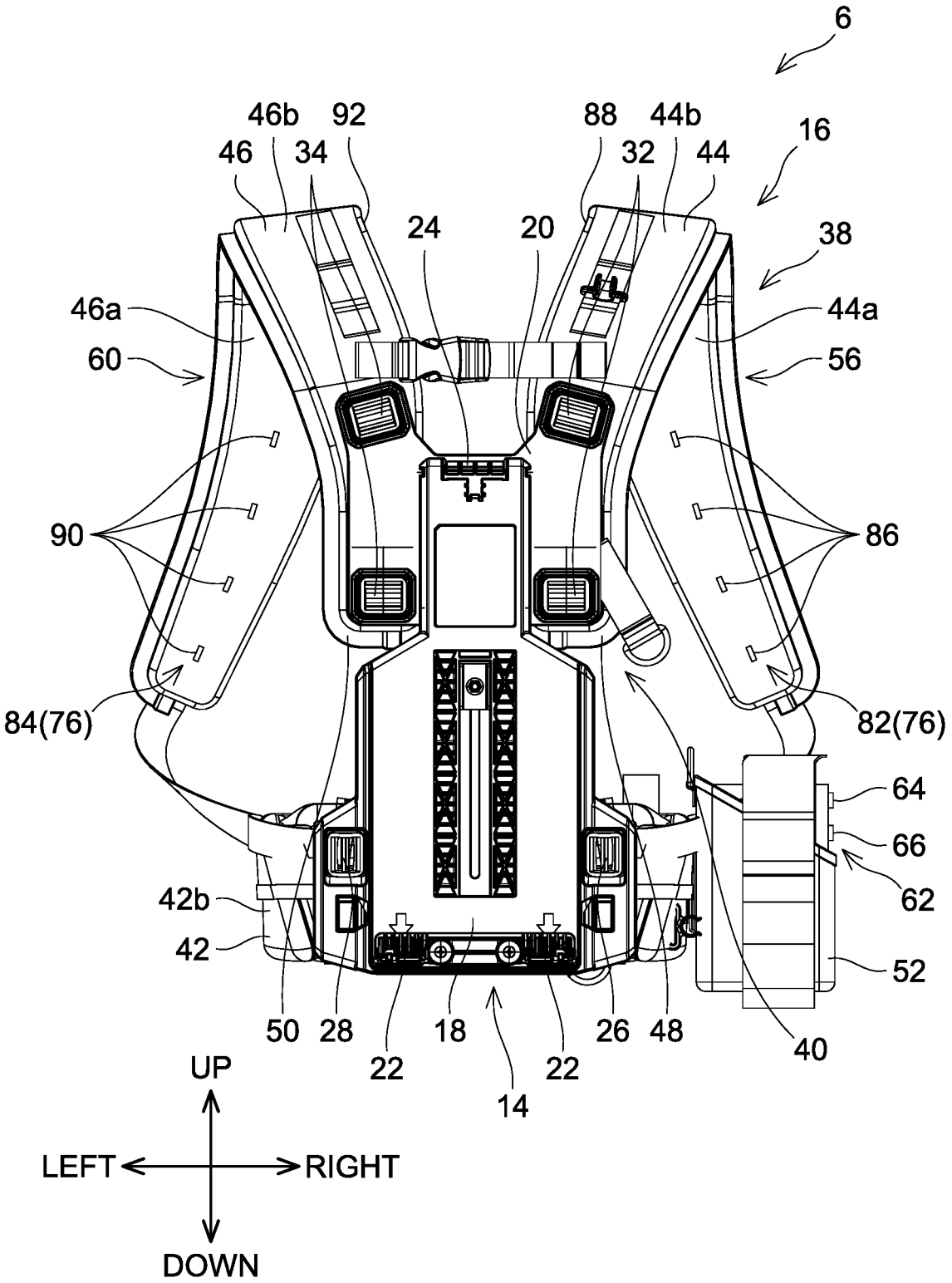
FIG. 2 is a back view of a base member 6 of the first embodiment.

As shown in FIG. 2, the base member 6 comprises aback plate 14 and a harness 16. The body 4 (see FIG. 1) is detachably attached to the back plate 14. The back plate 14 comprises a first back plate 18 and a second back plate 20.

The first back plate 18 comprises two lower engaging portions 22, one upper engaging portion 24, a right attaching portion 26, and a left attaching portion 28. The two lower engaging portions 22 are disposed in vicinity of a lower end of the first back plate 18. The one upper engaging portion 24 is disposed in vicinity of an upper end of the first back plate 18. In a state where the body 4 (see FIG. 1) is attached to the back plate 14, the two lower engaging portions 22 and the one upper engaging portion 24 engage with a front surface of the body 4 (see FIG. 1). The right attaching portion 26 is disposed in vicinity of a right end of a lower portion of the first back plate 18. The left attaching portion 28 is disposed in vicinity of a left end of the lower portion of the first back plate 18.

The second back plate 20 is attached to an upper portion of the first back plate 18 from a front side. The second back plate 20 protrudes to both right and left sides from the upper portion of the first back plate 18. The second back plate 20 comprises two right attaching portions 32 and two left attaching portions 34. The two right attaching portions 32 are disposed to the right of the upper portion of the first back plate 18, and the two left attaching portions 34 are disposed to the left of the upper portion of the first back plate 18.

Figure 3:
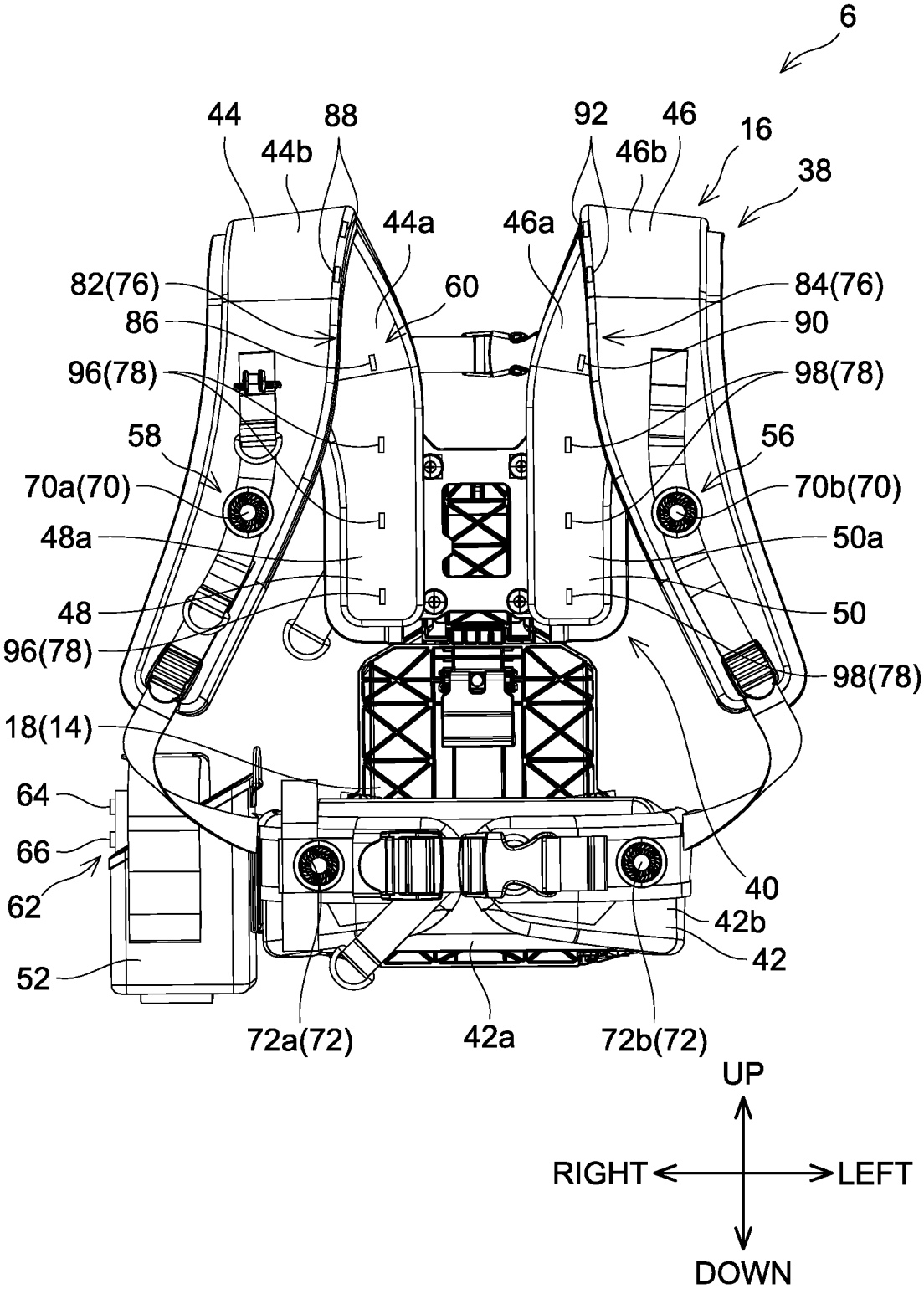
FIG. 3 is a front view of the base member 6 of the first embodiment.

As shown in FIG. 3, the harness 16 is detachably attached to the back plate 14. The harness 16 is used by being worn by the user. The harness 16 comprises at least one shoulder belt 38 (two in the present embodiment), at least one back pad 40 (two in the present embodiment), and a waist belt 42.

The shoulder belts 38 are constituted of a breathable fabric material that is capable of permeating moisture. The two shoulder belts 38 include a right shoulder belt 44 and a left shoulder belt 46. When the harness 16 is worn by the user, the right shoulder belt 44 is worn on the user's right shoulder, and the left shoulder belt 46 is worn on the user's left shoulder. In this state, a contact surface 44*a* of the right shoulder belt 44 contacts the user's right shoulder, and a contact surface 46*a* of the left shoulder belt 46 contacts the user's left shoulder.

The back pads 40 are constituted of a breathable fabric material that is capable of permeating moisture. The two back pads 40 include a right back pad 48 and a left back pad 50. When the harness 16 is worn by the user, a contact surface 48*a* of the right back pad 48 contacts an upper right portion of the user's back, and a contact surface 50*a* of the left back pad 50 contacts an upper left portion of the user's back. The right back pad 48 is integrated with the right shoulder belt 44. The left back pad 50 is integrated with the left shoulder belt 46.

As shown in FIG. 2, the right back pad 48 is detachably attached to the second back plate via the two right attaching portions 32 of the second back plate 20. A distal end of the right shoulder belt 44 is detachably attached to the first back plate 18 via the right attaching portion 26 of the first back plate 18. The left back pad 50 is detachably attached to the second back plate 20 via the two left attaching portions 34 of the second back plate 20. A distal end of the left shoulder belt 46 is detachably attached to the first back plate 18 via the left attaching portion 28 of the first back plate 18.

The waist belt 42 shown in FIG. 3 is constituted of a breathable fabric material that is capable of permeating moisture. The waist belt 42 is detachably attached to the lower portion of the first back plate 18. When the harness 16 is worn by the user, the waist belt 42 is worn on the user's waist. In this state, a contact surface 42*a* of the waist belt 42 contacts the user's waist. Further, the waist belt 42 has an attachment 52 detachably attached thereto. The attachment 52 has a box shape with its upper side opened.

When the user works in a state of wearing the backpack-type assembly 2 on his/her back, heat easily builds up at contacting portion(s) between the user's body and the harness 16. Due to this, the user may feel heat during the work. The backpack-type assembly 2 of the present embodiment comprises a cooling structure 56 for cooling the user's body.

Figure 4:
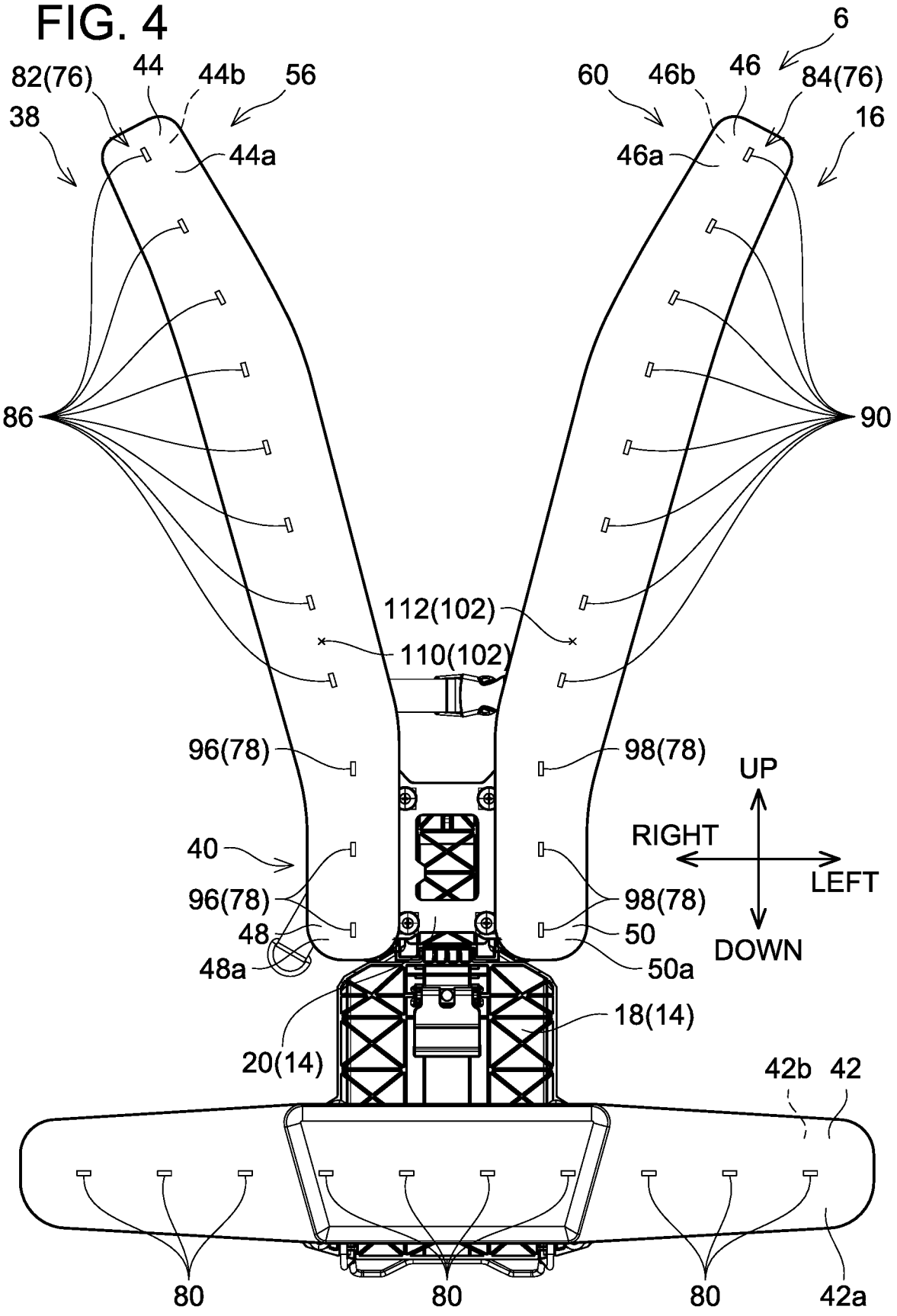
FIG. 4 is a front view of the base member 6 of the first embodiment in a state where shoulder belts 38 and a waist belt 42 are spread open.
Figure 5:
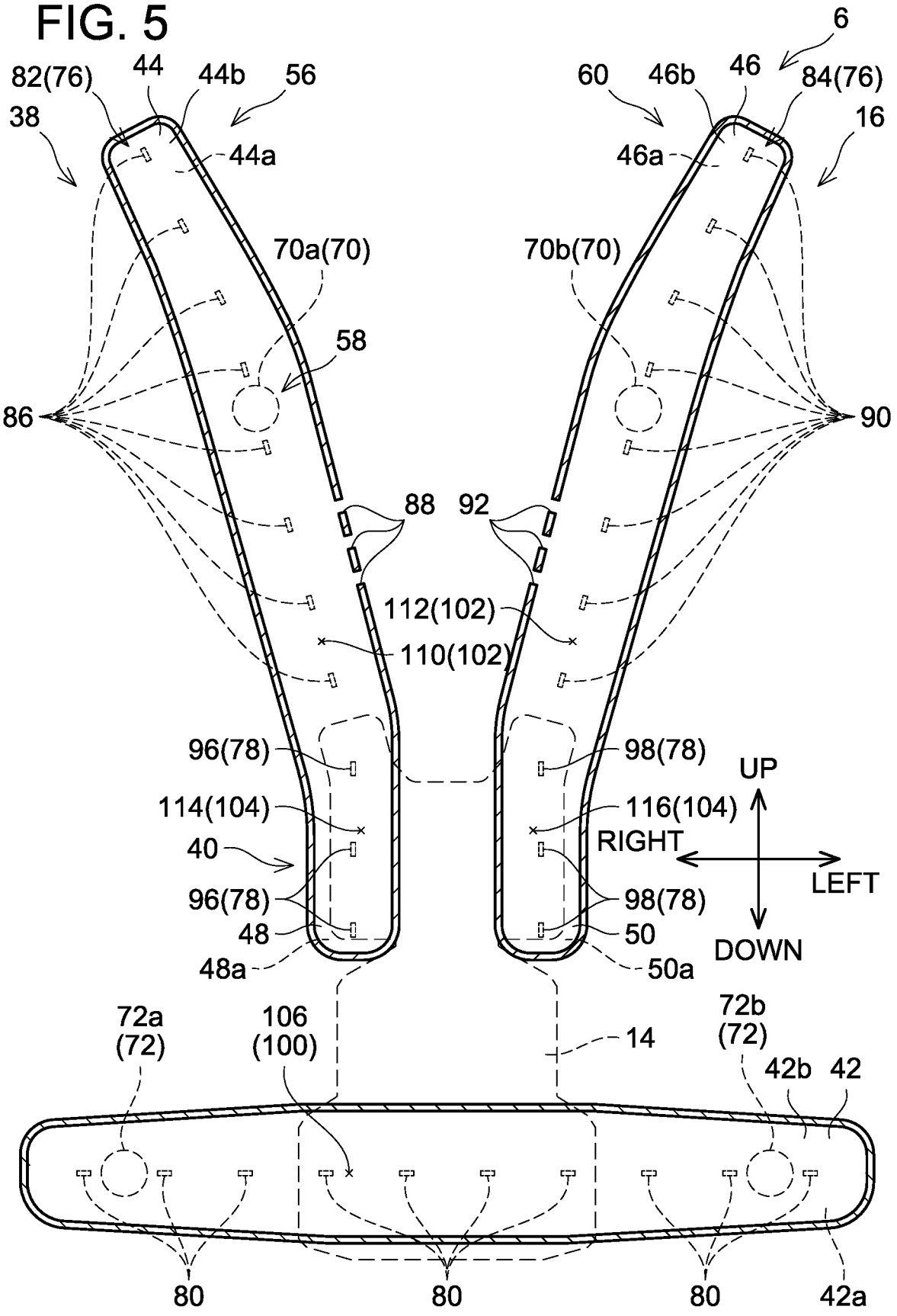
FIG. 5 is a cross-sectional view of a harness 16 of the first embodiment in the state where the shoulder belts 38 and the waist belt 42 are spread open.

As shown in FIGS. 3 to 5, the cooling structure 56 comprises one or more cooling fans 58 (four in the present embodiment) and a plurality of cooling ports 60. As shown in FIG. 3, the four cooling fans 58 may for example be axial fans. The four cooling fans 58 are configured to operate on electrical power supplied from an external power supply 62 through cables that are not shown. The external power supply 62 is attached to the attachment 52 by being housed in the attachment 52. The external power supply 62 comprises a shifter (on/off) switch 64 configured to switch an ON state and an OFF state of the cooling fans 58 and a flow rate adjusting switch 66 configured to adjust a flow rate of the cooling fans 58. The flow rate adjusting switch 66 may for example be configured to switch between a HIGH mode with a high flow rate and a LOW mode with a low flow rate.

The four cooling fans 58 include two shoulder cooling fans 70 and two waist cooling fans 72. The two shoulder cooling fans 70 include a right shoulder cooling fan 70*a* and a left shoulder cooling fan 70*b*. The right shoulder cooling fan 70*a* is disposed on a non-contacting surface 44*b* of the right shoulder belt 44. The non-contacting surface 44*b* of the right shoulder belt 44 is a surface that does not contact the user's right shoulder when the right shoulder belt 44 is worn on the user's right shoulder, and is a surface on an opposite side from the contact surface 44*a* of the right shoulder belt 44. The left shoulder cooling fan 70*b* is disposed on a non-contacting surface 46*b* of the left shoulder belt 46. The non-contacting surface 46*b* of the left shoulder belt 46 is a surface that does not contact the user's left shoulder when the left shoulder belt 46 is worn on the user's left shoulder, and is a surface on an opposite side from the contact surface 46*a* of the left shoulder belt 46.

The two waist cooling fans 72 include a right waist cooling fan 72*a* and a left waist cooling fan 72*b*. The right waist cooling fan 72*a* is disposed in vicinity of a right end of the non-contacting surface 42*b* of the waist belt 42 in a longitudinal direction. The left waist cooling fan 72*b* is disposed in vicinity of a left end of the non-contacting surface 42*b* of the waist belt 42 in the longitudinal direction. The non-contacting surface 42*b* of the waist belt 42 is a surface that does not contact the user's waist when the waist belt 42 is worn on the user's waist, and is a surface on an opposite side from the contact surface 42*a* of the waist belt 42.

As shown in FIG. 4, the plurality of cooling ports 60 includes one or more shoulder cooling ports 76, one or more back cooling ports 78, and one or more waist cooling ports 80 (ten in the present embodiment). The one or more shoulder cooling ports 76 include one or more right shoulder cooling ports 82 and one or more left shoulder cooling ports 84.

The right shoulder cooling ports 82 are disposed on the right shoulder belt 44. The one or more right shoulder cooling ports 82 include one or more first right shoulder cooling ports 86 (eight in the present embodiment) and one or more second right shoulder cooling ports 88 (three in the present embodiment; see FIG. 5). The eight first right shoulder cooling ports 86 are disposed on the contact surface 44*a* of the right shoulder belt 44. The eight first right shoulder cooling ports 86 are arranged in a line along the longitudinal direction of the contact surface 44*a* of the right shoulder belt 44. When the right shoulder belt 44 is worn on the user's right shoulder, the eight first right shoulder cooling ports 86 face (are directed toward) the user's right shoulder in vicinity of the user's right shoulder.

The three second right shoulder cooling ports 88 shown in FIG. 5 are disposed in vicinity of a boundary between the contact surface 44*a* (see FIG. 4) and the non-contacting surface 44*b* of the right shoulder belt 44. The three second right shoulder cooling ports 88 are arranged in a line along the longitudinal direction of the right shoulder belt 44. When the right shoulder belt 44 is worn on the user's right shoulder, the three second right shoulder cooling ports 88 face the user's face or neck in vicinity of the user's right shoulder.

As shown in FIG. 4, the left shoulder cooling ports 84 are disposed on the left shoulder belt 46. The one or more left shoulder cooling ports 84 include one or more first left shoulder cooling ports 90 (eight in the present embodiment) and one or more second left shoulder cooling ports 92 (three in the present embodiment; see FIG. 5). The eight first left shoulder cooling ports 90 are disposed on the contact surface 46*a* of the left shoulder belt 46. The eight first left shoulder cooling ports 90 are arranged in a line along the longitudinal direction of the contact surface 46*a* of the left shoulder belt 46. When the left shoulder belt 46 is worn on the user's left shoulder, the eight first left shoulder cooling ports 90 face the user's left shoulder in vicinity of the user's left shoulder.

The three second left shoulder cooling ports 92 shown in FIG. 5 are disposed in vicinity of a boundary between the contact surface 46*a* (see FIG. 4) and the non-contacting surface 46*b* of the left shoulder belt 46. The three second left shoulder cooling ports 92 are arranged in a line along the longitudinal direction of the left shoulder belt 46. When the left shoulder belt 46 is worn on the user's left shoulder, the three second left shoulder cooling ports 92 face the user's face or neck in vicinity of the user's left shoulder.

As shown in FIG. 4, the one or more back cooling ports 78 include one or more right back cooling ports 96 (three in the present embodiment) and one or more left back cooling ports 98 (three in the present embodiment). The three right back cooling ports 96 are disposed on the contact surface 48*a* of the right back pad 48. The three right back cooling ports 96 are arranged in a line along the longitudinal direction of the contact surface 48*a* of the right back pad 48. When the right back pad 48 is in contact with the user's back, the three right back cooling ports 96 face the user's back in vicinity of the user's back.

The three left back cooling ports 98 are disposed on the contact surface 50*a* of the left back pad 50. The three left back cooling ports 98 are arranged in a line along the longitudinal direction of the contact surface 50*a* of the left back pad 50. When the left back pad 50 is in contact with the user's back, the three left back cooling ports 98 face the user's back in vicinity of the user's back.

The ten waist cooling ports 80 are disposed on the contact surface 42*a* of the waist belt 42. The ten waist cooling ports 80 are arranged in a line along the longitudinal direction of the contact surface 42*a* of the waist belt 42. When the waist belt 42 is worn on the user's waist, the ten waist cooling ports 80 face the user's waist in vicinity of the user's waist.

As shown in FIG. 5, the cooling structure 56 further comprises an air passage 100. Cooling air flows in the air passage 100 by operation of the four cooling fans 58. The air passage 100 includes one or more shoulder air passages 102, one or more back air passages 104, and one or more waist cooling air passages 106 (one in the present embodiment).

The one or more shoulder air passages 102 include one or more right shoulder air passages 110 (one in the present embodiment) and one or more left shoulder air passages 112 (one in the present embodiment). The right shoulder air passage 110 is defined inside the right shoulder belt 44. The right shoulder air passage 110 communicates with outside of the right shoulder belt 44 through the plurality of right shoulder cooling ports 82. The left shoulder air passage 112 is defined inside the left shoulder belt 46. The left shoulder air passage 112 communicates with outside of the left shoulder belt 46 through the plurality of left shoulder cooling ports 84.

The one or more back air passages 104 include one or more right back air passage 114 (one in the present embodiment) and one or more left back air passage 116 (one in the present embodiment). The right back air passage 114 is defined inside the right back pad 48. The right back air passage 114 communicates with outside of the right back pad 48 through the three right back cooling ports 96. Further, the right back air passage 114 communicates with the right shoulder air passage 110. The left back air passage 116 is defined inside the left back pad 50. The left back air passage 116 communicates with outside of the left back pad 50 through the three left back cooling ports 98. Further, the left back air passage 116 communicates with the left shoulder air passage 112.

The waist cooling air passage 106 is defined inside the waist belt 42. The waist cooling air passage 106 communicates with outside of the waist belt 42 through the ten waist cooling ports 80.

Next, a method of cooling the user's body by the operation of the four cooling fans 58 will be described. Firstly, a case in which the cooling air flows out from the plurality of cooling ports 60 by the operation of the four cooling fans 58 will be described. When the user operates the shifter switch 64 (see FIG. 3) of the external power supply 62 in the state of wearing the backpack-type assembly 2 (see FIG. 1) on his/her back and the four cooling fans 58 thereby switch to the ON state, the four cooling fans 58 start operating. As shown in FIG. 5, when the right shoulder cooling fan 70*a* operates, the cooling air flows into the right shoulder air passage 110 from the outside of the right shoulder belt 44 through the right shoulder cooling fan 70*a*. A part of the cooling air that flowed in flows out to the outside of the right shoulder belt 44 from the eight first right shoulder cooling ports 86 as it flows in the right shoulder air passage 110, and also flows out to the outside of the right shoulder belt 44 from the three second right shoulder cooling ports 88. The cooling air that flowed out from the first right shoulder cooling ports 86 flows along a surface of the user's right shoulder and cools the user's right shoulder. The cooling air that flowed out from the second right shoulder cooling ports 88 flows along a surface of the user's face or neck, and cools the user's face or neck. Remainder of the cooling air flowing in the right shoulder air passage 110 flows from the right shoulder air passage 110 into the right back air passage 114, and flows out to the outside of the right back pad 48 from the three right back cooling ports 96. The cooling air that flowed out flows along a surface of the user's back, and cools the user's back. Since the right shoulder belt 44 and the right back pad 48 are constituted of the breathable fabric material, moisture in vicinities of the right shoulder belt 44 and the right back pad 48 is ventilated as the cooling air flows in the right shoulder air passage 110 and the right back air passage 114, thus the moisture on the user's right shoulder and back is reduced. Further, when the cooling air flows in the right shoulder air passage 110 and the right back air passage 114, the right shoulder belt 44 and the right back pad 48 are thereby cooled, and this reduces the heat that the user may be feeling.

Further, when the left shoulder cooling fan 70*b* operates, the cooling air flows into the left shoulder air passage 112 from the outside of the left shoulder belt 46 through the left shoulder cooling fan 70*b*. A part of the cooling air that flowed in flows back to the outside of the left shoulder belt 46 from the eight first left shoulder cooling ports 90 as it flows in the left shoulder air passage 112, and also flows out to the outside of the left shoulder belt 46 from the three second left shoulder cooling ports 92. The cooling air that flowed out from the first left shoulder cooling ports 90 flows along a surface of the user's left shoulder and cools the user's left shoulder. The cooling air that flowed out from the second left shoulder cooling ports 92 flows along a surface of the user's face or neck, and cools the user's face or neck. Remainder of the cooling air flowing in the left shoulder air passage 112 flows from the left shoulder air passage 112 into the left back air passage 116, and flows out to the outside of the left back pad 50 from the three left back cooling ports 98. The cooling air that flowed out flows along the surface of the user's back, and cools the user's back. Since the left shoulder belt 46 and the left back pad 50 are constituted of the breathable fabric material, moisture in vicinities of the left shoulder belt 46 and the left back pad 50 is ventilated as the cooling air flows in the left shoulder air passage 112 and the left back air passage 116, thus the moisture on the user's left shoulder and back is reduced. Further, when the cooling air flows in the left shoulder air passage 112 and the left back air passage 116, the left shoulder belt 46 and the left back pad 50 are thereby cooled, and this reduces the heat that the user may be feeling.

Further, when the right waist cooling fan 72*a* and the left waist cooling fan 72*b* operate, the cooling air flows into the waist cooling air passage 106 from the outside of the waist belt 42 through the right waist cooling fan 72*a* and the left waist cooling fan 72*b*. The cooling air that flowed in flows in the waist cooling air passage 106, and flows out to the outside of the waist belt 42 from the ten waist cooling ports 80. The air that flowed out flows along a surface of the user's waist, and thereby cools the user's waist. Since the waist belt 42 is constituted of the breathable fabric material, moisture in vicinity of the waist belt 42 is ventilated as the cooling air flows in the waist cooling air passage 106, thus the moisture on the user's waist is reduced. Further, when the cooling air flows in the waist cooling air passage 106, the waist belt 42 is thereby cooled, and this reduces the heat that the user may be feeling.

Next, a case in which the cooling air flows in from the plurality of cooling ports 60 by the operation of the four cooling fans 58 will be described. As shown in FIG. 5, when the right shoulder cooling fan 70*a* operates, the cooling air flows from the vicinity of the user's right shoulder into the right shoulder air passage 110 through the eight first right shoulder cooling ports 86. Due to this, the cooling air flows along the surface of the user's right shoulder and cools the user's right shoulder. Further, the cooling air flows from the vicinity of the user's face or neck into the right shoulder air passage 110 through the three second right shoulder cooling ports 88. At this occasion, the cooling air flows along the surface of the user's face or neck and cools the user's face or neck. Furthermore, the cooling air flows from the vicinity of the user's back into the right back air passage 114 through the three right back cooling ports 96 and flows to the right shoulder air passage 110. At this occasion, the cooling air flows along the surface of the user's back and cools the user's back. The cooling air flows through the right shoulder air passage 110, and is thereafter fed out to the outside of the right shoulder belt 44 by the right shoulder cooling fan 70*a*.

Further, when the left shoulder cooling fan 70*b* operates, the cooling air flows from the vicinity of the user's left shoulder into the left shoulder air passage 112 through the eight first left shoulder cooling ports 90. At this occasion, the cooling air flows along the surface of the user's left shoulder and cools the user's left shoulder. Further, the cooling air flows from the vicinity of the user's face or neck into the left shoulder air passage 112 through the three second left shoulder cooling ports 92. At this occasion, the cooling air flows along the surface of the user's face or neck and cools the user's face or neck. Furthermore, the cooling air flows from the vicinity of the user's back into the left back air passage 116 through the three left back cooling ports 98 and flows to the left shoulder air passage 112. At this occasion, the cooling air flows along the surface of the user's back and cools the user's back. The cooling air flows through the left shoulder air passage 112, and is thereafter fed out to the outside of the left shoulder belt 46 by the left shoulder cooling fan 70*b*.

Further, when the right waist cooling fan 72*a* and the left waist cooling fan 72*b* operate, the cooling air flows from the vicinity of the user's waist into the waist cooling air passage 106 through the ten waist cooling ports 80. Due to this, the cooling air flows along the surface of the user's waist and cools the user's waist. The cooling air flows in the waist cooling air passage 106, and is thereafter fed out to the outside of the waist belt 42 by the right waist cooling fan 72*a* and the left waist cooling fan 72*b*.

Effects

In the present embodiment, the backpack-type assembly 2 comprises the body 4 and the base member 6 that includes the cooling ports 60. The base member 6 comprises the back plate 14 attached to the body 4, and the harness 16 attached to the back plate 14 and configured to be worn on the user. The harness 16 comprises at least one shoulder belt 38 configured to be worn on the user's shoulder, and the cooling fans 58. The cooling fans 58 are configured to circulate the cooling air through the cooling ports 60 of the base member 6.

According to the above configuration, the user's body can be cooled by operating the cooling fans 58 while the user is wearing the backpack-type assembly 2 on his/her back. Due to this, an occurrence of a situation in which the user feels heat while the user is wearing the backpack-type assembly 2 on his/her back can be suppressed.

Further, the cooling ports 60 are disposed in the vicinity of the user when the user wears the harness 16.

According to the above configuration, when the cooling air circulates through the cooling ports 60, the cooling air flows in the vicinity of the user's body. Due to this, the occurrence of the situation in which the user feels heat while the user is wearing the backpack-type assembly 2 on his/her back can further be suppressed.

Further, the cooling ports 60 face the user when the user wears the harness 16.

According to the above configuration, when the cooling air circulates through the cooling ports 60, the cooling air flows along user's body surface. Due to this, the occurrence of the situation in which the user feels heat while the user is wearing the backpack-type assembly 2 on his/her back can further be suppressed.

Further, the harness 16 further comprises the back pads 40 configured to be in contact with the user's back when the user wears the harness 16. The cooling ports 60 face portions of the user's back in contact with the back pads 40 when the user wears the harness 16.

When the harness 16 comprises the back pads 40, heat easily builds up on the user's back due to the back pads 40 being in contact with the user's back. According to the above configuration, when the cooling air circulates through the cooling ports 60, the cooling air flows along the surfaces of the portions of the user's back that are in contact with the back pads 40. Due to this, the occurrence of the situation in which the user feels heat while the user is wearing the backpack-type assembly 2 on his/her back can further be suppressed.

Further, the shoulder cooling ports 76 are disposed on the shoulder belts 38.

When the user wears the backpack-type assembly 2 on his/her back, heat easily builds up on the user's shoulders since the shoulder belts 38 contact the user's shoulders. According to the above configuration, when the cooling air circulates through the shoulder cooling ports 76, the cooling air flows along the surfaces of the user's shoulders. Due to this, the occurrence of the situation in which the user feels heat while the user is wearing the backpack-type assembly 2 on his/her back can further be suppressed.

Further, the harness 16 further comprises the waist belt 42 configured to be worn on the user's waist. The waist cooling ports 80 are disposed on the waist belt 42.

When the harness 16 has the waist belt 42, the waist belt 42 comes into contact with the user's waist. Due to this, heat may easily build up on the user's waist. According to the above configuration, when the cooling air circulates through the waist cooling ports 80, the cooling air flows along the surface of the user's waist. Due to this, the occurrence of the situation in which the user feels heat while the user is wearing the backpack-type assembly 2 on his/her back can further be suppressed.

Further, the waist cooling fans 72 are disposed on the waist belt 42.

According to the above configuration, the waist cooling fans 72 can be disposed without arranging separate member(s) for disposing the waist cooling fans 72 on the base member 6.

Further, the shoulder cooling fans 70 are disposed on the shoulder belts 38.

According to the above configuration, the shoulder cooling fans 70 can be disposed without arranging separate member(s) for disposing the shoulder cooling fans 70 on the base member 6.

Further, the backpack-type assembly 2 further comprises the external power supply 62 configured to supply electrical power to the cooling fans 58.

According to the above configuration, the cooling fans 58 can be operated even when electrical power is not supplied from the body 4 to the cooling fans 58.

Further, the base member 6 comprises the attachment 52 configured to detachably attach the external power supply 62 thereto.

According to the above configuration, the user can carry the external power supply 62 by wearing the backpack-type assembly 2 on his/her back.

Further, the cooling fans 58 are configured so that the flow rate is adjustable.

According to the above configuration, the flow rate of the cooling fans 58 can be adjusted in accordance with the degree of heat which the user feels.

Further, the body 4 is configured to be connected to the electrical working machine having the motor. The body 4 is configured to supply electrical power to the motor of the electrical working machine.

According to the above configuration, the occurrence of the situation in which the user feels heat while the user is wearing the backpack-type assembly 2 which supplies electrical power to the electrical working machine on his/her back can be avoided.

Further, the harness 16 comprises the air passage 100 communicating with the cooling ports 60. The cooling air flows in the air passage 100 when the cooling fans 58 operate.

According to the above configuration, the harness 16 can be cooled by the cooling air flowing to the air passage 100. Due to this, the occurrence of the situation in which the user feels heat while the user is wearing the backpack-type assembly 2 on his/her back can further be suppressed.

Second Embodiment

A second embodiment will be described with reference to FIGS. 6 and 7. In the second embodiment, features that differ from the first embodiment will be described, and features that are same as the first embodiment will be given the same reference signs and description thereof will be omitted. In the second embodiment, arrangements of three right back cooling ports 96, three left back cooling ports 98, and four waist cooling ports 80 among a plurality of waist cooling ports 80 differ from those of the first embodiment. Hereinbelow, the four waist cooling ports 80 among the plurality of waist cooling ports 80 will be termed center waist cooling ports 180.

Figure 6:
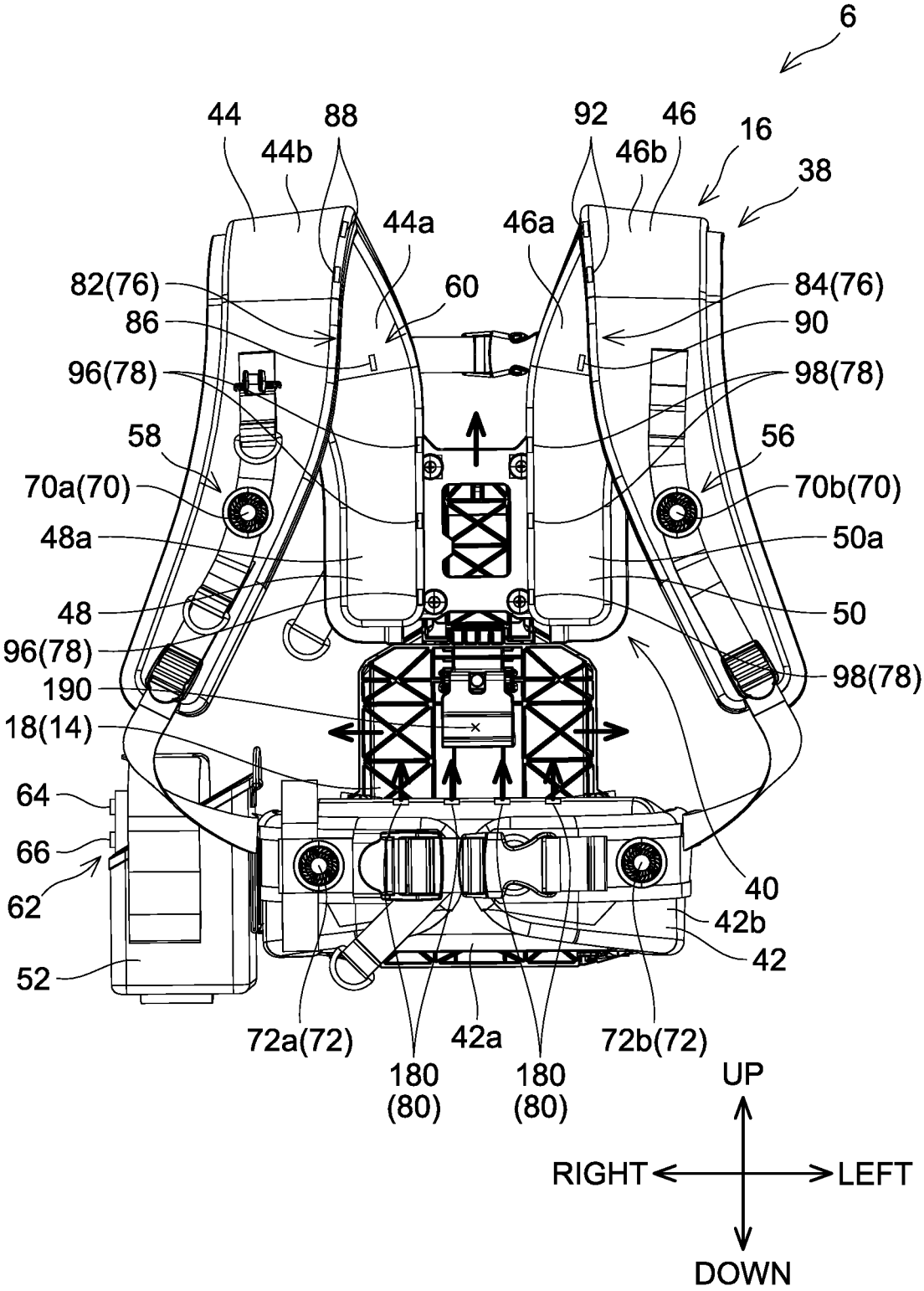
FIG. 6 is a front view of a base member 6 of a second embodiment.

The three right back cooling ports 96 shown in FIG. 6 are disposed in vicinity of a boundary between the contact surface 48*a* and a non-contacting surface of the right back pad 48. The non-contacting surface of the right back pad 48 is a surface that does not contact the user's back when the right back pad 48 is in contact with the user's back, and is a surface on an opposite side from the contact surface 48*a* of the right back pad 48. The three right back cooling ports 96 are disposed at a left end of the right back pad 48.

The three left back cooling ports 98 are disposed in vicinity of a boundary between the contact surface 50*a* and a non-contacting surface of the left back pad 50. The non-contacting surface of the left back pad 50 is a surface that does not contact the user's back when the left back pad 50 is in contact with the user's back, and is a surface on an opposite side from the contact surface 50*a* of the left back pad 50. The three left back cooling ports 98 are disposed at a right end of the left back pad 50. Each of the three left back cooling ports 98 faces its corresponding one of the three right back cooling ports 96.

Figure 7:
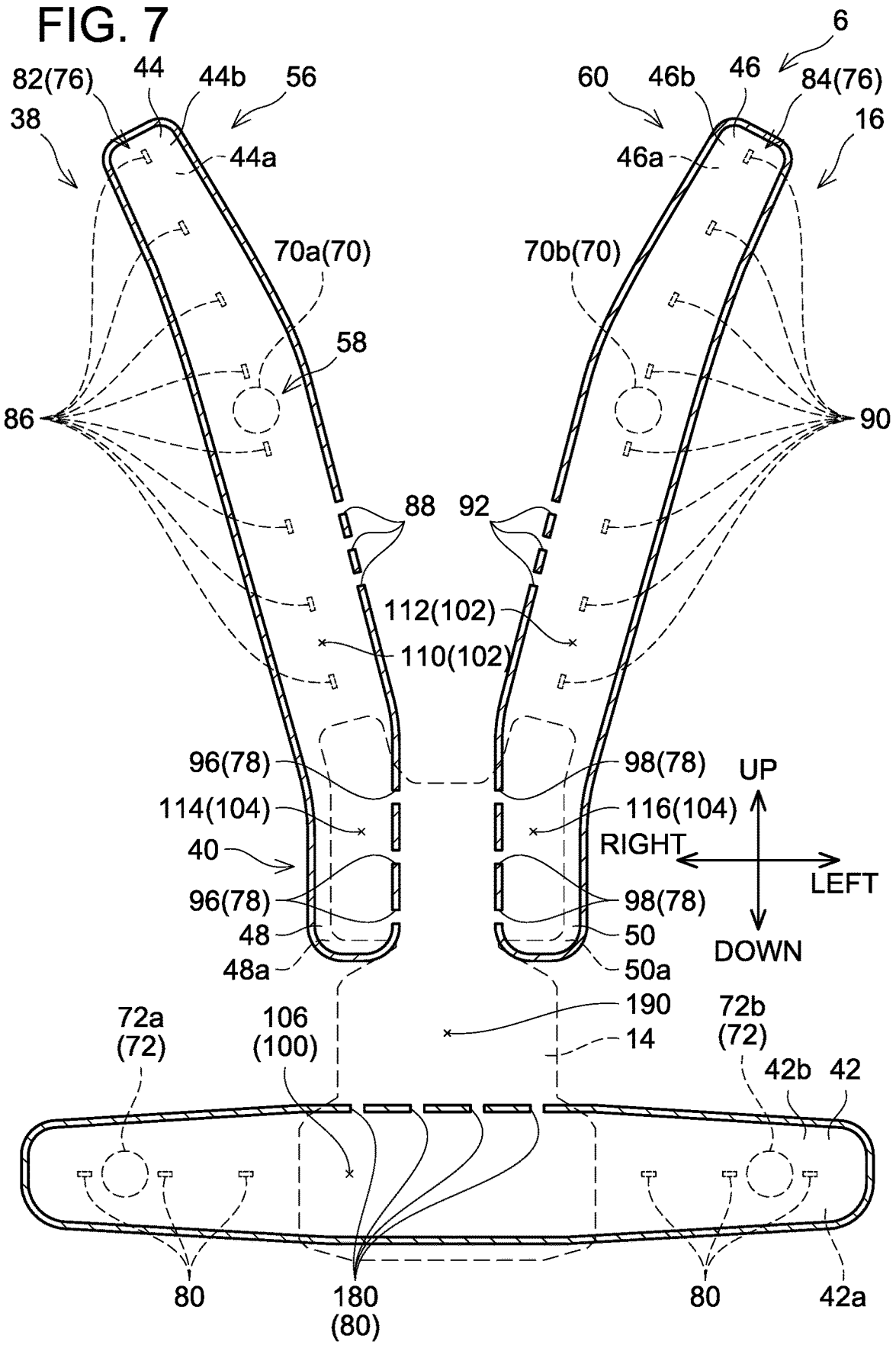
FIG. 7 is a cross-sectional view of a harness 16 of the second embodiment in a state where shoulder belts 38 and a waist belt 42 are spread open.

The four center waist cooling ports 180 shown in FIG. 7 are disposed in vicinity of a boundary between the contact surface 42*a* and the non-contacting surface 42*b* of the waist belt 42 (see FIG. 6). The four center waist cooling ports 180 are disposed at an upper end of the waist belt 42.

As shown in FIG. 6, a non-contacting space 190 is defined between the right back pad 48 and the left back pad 50 (being a space along the left-right direction) and between the back pads and the waist belt 42 (being a space along the up-down direction). When the harness 16 is worn by the user, the non-contacting space 190 is disposed between the user's back and the back plate 14. Further, when the harness 16 is worn by the user, the back pads 40 and the waist belt 42 are not disposed in the non-contacting space 190. When the harness 16 is worn by the user, the three right back cooling ports 96, the three left back cooling ports 98, and the four center waist cooling ports 180 all face the non-contacting space 190.

Next, the method of cooling the user's body by the operation of the four cooling fans 58 will be described. Hereinbelow, only the flow of the cooling air flowing through the three right back cooling ports 96, the three left back cooling ports 98, and the four center waist cooling ports 180 will be described. Firstly, the case in which the cooling air flows out from the plurality of cooling ports 60 by the operation of the four cooling fans 58 will be described. In FIG. 6, directions of the flow of the cooling air are partly indicated by arrows. After the cooling air flowed in the right back air passage 114 inside the right back pad 48 (see FIG. 7) by the operation of the right shoulder cooling fan 70*a*, the cooling air flows out to the non-contacting space 190 through the three right back cooling ports 96. Further, after the cooling air flowed in the left back air passage 116 inside the left back pad 50 (see FIG. 7) by the operation of the left shoulder cooling fan 70*b*, it flows out to the non-contacting space 190 through the three left back cooling ports 98. Furthermore, after the cooling air flowed in the waist cooling air passage 106 inside the waist belt 42 (see FIG. 7) by the operation of the right waist cooling fan 72*a* and the left waist cooling fan 72*b*, the cooling air flows out to the non-contacting space 190 through the four center waist cooling ports 180. The cooling air that flowed out flows along the surface of the user's back as it flows in the non-contacting space 190, and thereby cools the user's back. After this, the cooling air flows in the directions of the arrows of FIG. 6, and flows out to the space outside the non-contacting space 190.

Next, the case in which the cooling air flows in from the plurality of cooling ports 60 by the operation of the four cooling fans 58 will be described. When the four cooling fans 58 operate, the cooling air flows in directions opposite to the arrows in FIG. 6, and flows into the non-contacting space 190 from the space outside the non-contacting space 190. The cooling air that flowed in flows along the surface of the user's back as it flows in the non-contacting space 190 and cools the user's back. After this, the cooling air flows into the right back air passage 114 (see FIG. 7) through the three right back cooling ports 96. Further, the cooling air flows into the left back air passage 116 (see FIG. 7) through the three left back cooling ports 98. Furthermore, the cooling air flows into the waist cooling air passage 106 (see FIG. 7) through the four center waist cooling ports 180.

Effects

In the present embodiment, the harness 16 further comprises the back pads 40 that contact the user's back when the user wears the harness 16. When the user wears the harness 16, the non-contacting space 190 in which the back pads 40 are not disposed is defined between the user's back and the back plate 14. The cooling ports 60 face the non-contacting space 190 when the user wears the harness 16.

When the harness 16 comprises the back pads 40, heat easily builds up on the user's back due to the back pads 40 being in contact with the user's back. According to the above configuration, when the cooling air circulates through the cooling ports 60, the cooling air flows along the surface of the user's back in the non-contacting space 190. Due to this, the occurrence of the situation in which the user feels heat while the user is wearing the backpack-type assembly 2 on his/her back can further be suppressed.

Third Embodiment

A third embodiment will be described with reference to FIGS. 8 and 9. In the third embodiment, features that differ from the second embodiment will be described, and features that are same as the second embodiment will be given the same reference signs and description thereof will be omitted. In the third embodiment, at least one cooling fan 58 further comprises a back plate-side cooling fan 258.

Figure 8:
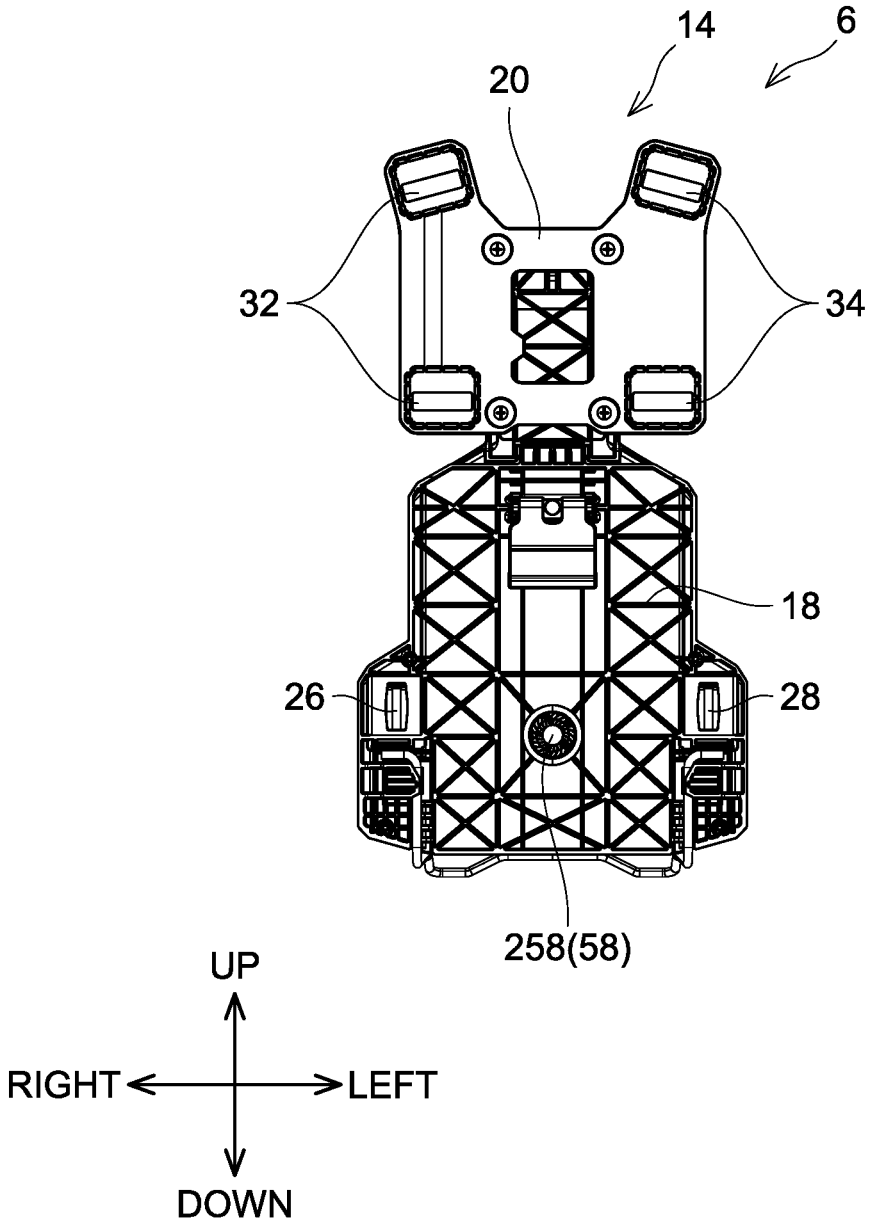
FIG. 8 is a front view of a back plate 14 of a third embodiment.
Figure 9:
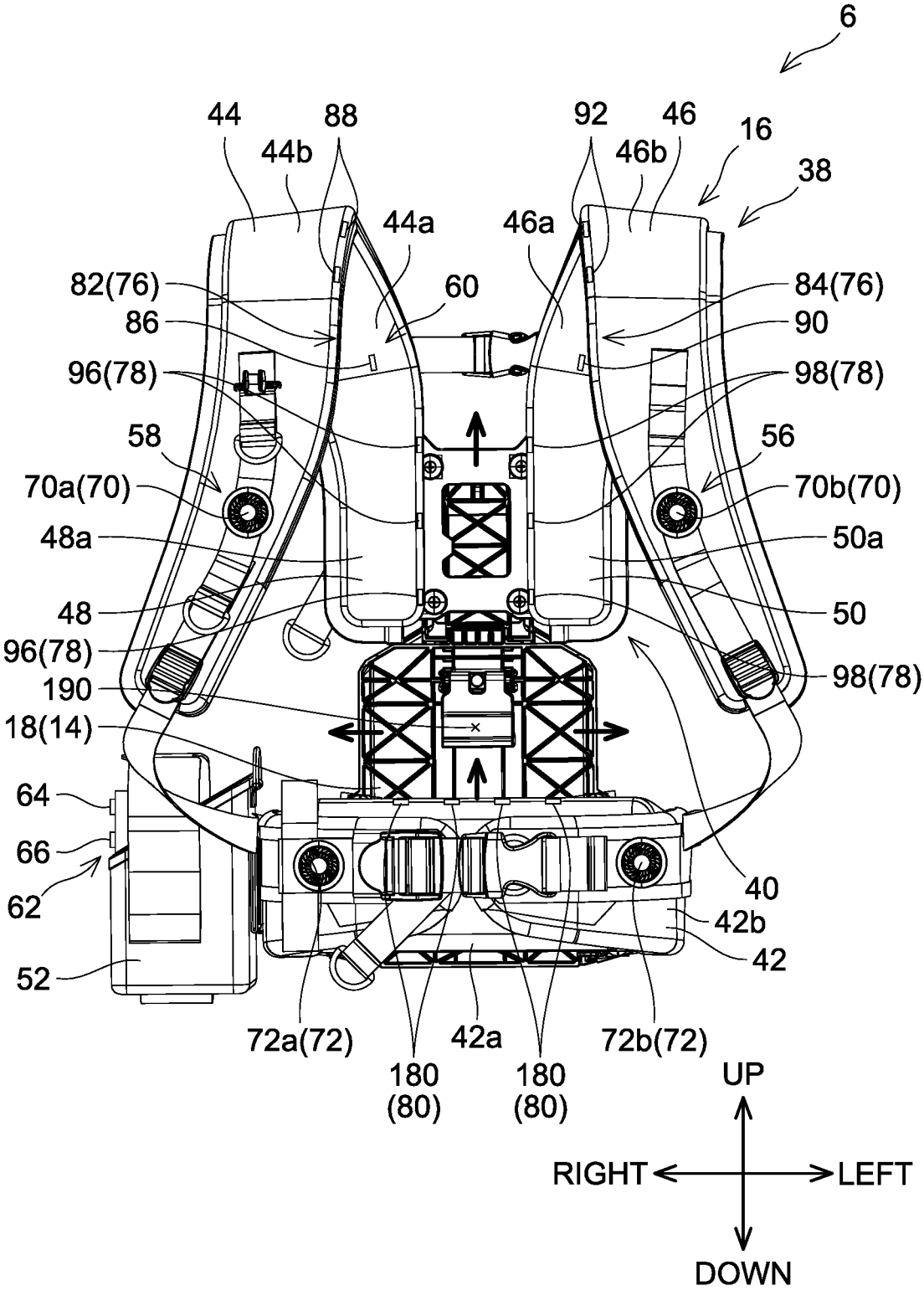
FIG. 9 is a front view of a base member 6 of the third embodiment.

As shown in FIG. 8, the back plate-side cooling fan 258 is disposed at the lower portion of the first back plate 18. The back plate-side cooling fan 258 is disposed by penetrating the first back plate 18 in its thickness direction (front-rear direction). The back plate-side cooling fan 258 is disposed between the right attaching portion 26 and the left attaching portion 28 of the first back plate 18. The back plate-side cooling fan 258 is configured to operate on electrical power supplied from the external power supply 62 (see FIG. 9) through a cable that is not shown. As shown in FIG. 9, when the base member 6 is seen in a front view, the back plate-side cooling fan 258 is not visible by being hidden behind the waist belt 42.

Next, the method of cooling the user's body by operation of the back plate-side cooling fan 258 will be described. Firstly, the method of cooling the user's body by the cooling air that flows in directions of arrows in FIG. 9 will be described. When the back plate-side cooling fan 258 operates, the cooling air from outside flows to the back plate-side cooling fan 258 from a space between the body 4 (see FIG. 1) and the first back plate 18, and is fed out to a space between the waist belt 42 and the first back plate 18 by the back plate-side cooling fan 258. After this, a part of the cooling air flows in the directions of the arrows in FIG. 9, and flows to the non-contacting space 190 from the space between the waist belt 42 and the first back plate 18. The cooling air that flowed in flows along the surface of the user's back while it flows in the non-contacting space 190, and thereby cools the user's back. After this, the cooling air flows out to the space outside the non-contacting space 190.

Next, the method of cooling the user's body by the cooling air that flows in opposite directions to the arrows in FIG. 9 will be described. When the back plate-side cooling fan 258 operates, the cooling air flows in the opposite directions to the arrows in FIG. 9 and flows into the non-contacting space 190 from the space outside the non-contacting space 190. The air that flowed in flows along the surface of the user's back as it flows in the non-contacting space 190, and cools the user's back. After this, the cooling air flows into the space between the waist belt 42 and the first back plate 18 from the non-contacting space 190. The cooling air that flowed in flows in the space between the waist belt 42 and the first back plate 18, and is thereafter fed out to the space between the body 4 (see FIG. 1) and the first back plate 18 by the back plate-side cooling fan 258. After this, the cooling air flows out to the outside from the space between the body 4 and the first back plate 18.

Effects

In the present embodiment, the back plate-side cooling fan 258 is disposed on the back plate 14.

According to the above configuration, the back plate-side cooling fan 258 can be disposed without arranging a separate member for disposing the back plate-side cooling fan 258 on the base member 6.

Corresponding Relationship

The space between the waist belt 42 and the first back plate 18 is an example of "cooling port".

Fourth Embodiment

Figure 10:
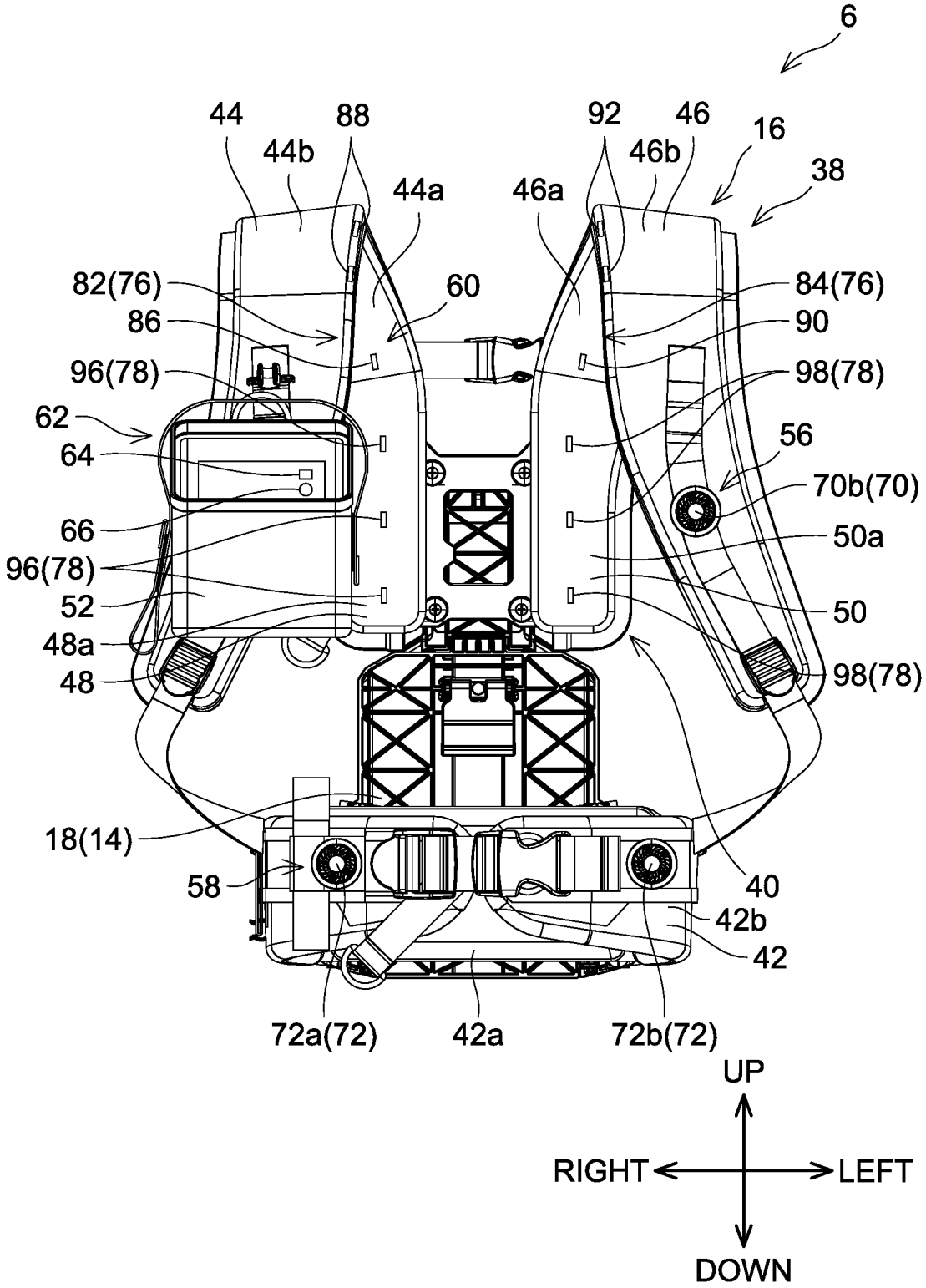
FIG. 10 is a front view of a base member 6 of a fourth embodiment.

A fourth embodiment will be described with reference to FIG. 10. In the fourth embodiment, features that differ from the first embodiment will be described, and features that are same as the first embodiment will be given the same reference signs and description thereof will be omitted. In the fourth embodiment, a location where the attachment 52 is attached differs from that of the first embodiment.

The attachment 52 is detachably attached to the right shoulder belt 44. In this case, the user can operate the shifter switch 64 of the external power supply 62 and the flow rate adjusting switch 66 by his/her left hand, for example. In a variant, the attachment 52 may be detachably attached to the left shoulder belt 46.

Fifth Embodiment

Figure 11:
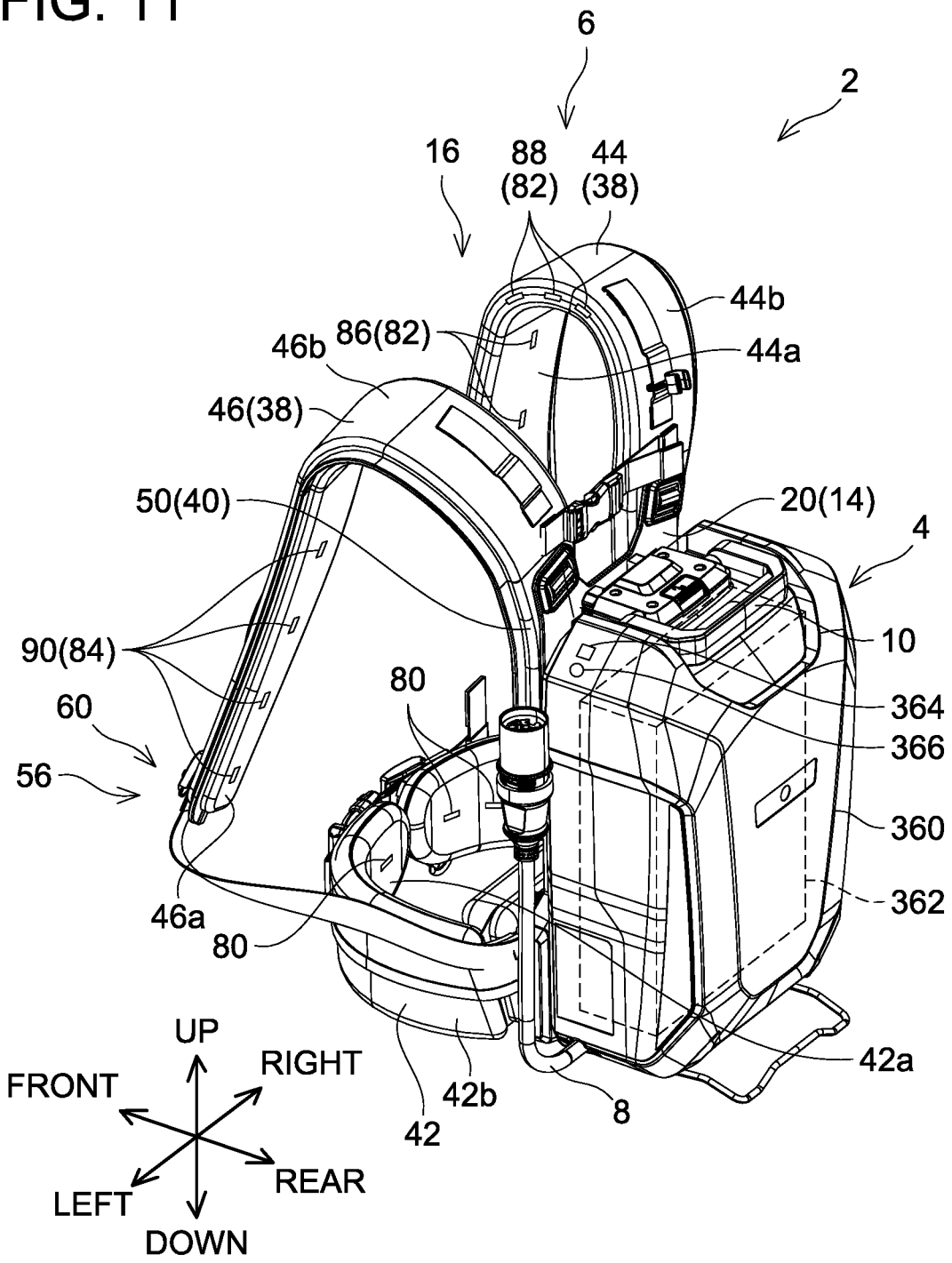
FIG. 11 is a perspective view of a backpack-type assembly 2 of a fifth embodiment.

A fifth embodiment will be described with reference to FIG. 11. In the fifth embodiment, features that differ from the first embodiment will be described, and features that are same as the first embodiment will be given the same reference signs and description thereof will be omitted. In the fifth embodiment, the backpack-type assembly 2 does not comprise the attachment 52 and the external power supply 62. The four cooling fans 58 operate on electrical power supplied from the body 4.

The body 4 includes a body casing 360, a battery 362, an shifter switch 364, and a flow rate adjusting switch 366. The battery 362 is housed inside the body casing 360. The battery 362 may for example be a rechargeable secondary battery. Electrical power from the battery 362 is supplied to the four cooling fans 58 (see FIG. 3) through cables that are not shown. Further, the electrical power from the battery 362 is also supplied to the electrical working machine having the motor (not shown) through the connection cable 8.

The shifter switch 364 and the flow rate adjusting switch 366 are disposed on an outer surface of the body casing 360. The shifter switch 364 is configured to switch the ON state and the OFF state of the cooling fans 58. The flow rate adjusting switch 366 is configured to adjust the flow rate of the cooling fans 58.

Effects

In the present embodiment, the body 4 is electrically connected to the cooling fans 58 and is configured to supply electrical power to the cooling fans 58.

According to the above configuration, the cooling fans 58 can be operated even in cases where the backpack-type assembly 2 does not have the external power supply for supplying electrical power to the cooling fans 58.

Variants

In an embodiment, the body 4 may be integrated with the back plate 14.

In an embodiment, the body 4 may be a working machine. The body 4 may for example be a dust collector, a blower, or a mist blower.

In an embodiment, the right shoulder belt 44 and the right back pad 48 may be separate members. Further, the left shoulder belt 46 and the left back pad 50 may be separate members.

In an embodiment, the right shoulder belt 44 and the left shoulder belt 46 may be integrated. Further, the right back pad 48 and the left back pad 50 may be integrated.

In an embodiment, the air passage 100 may include therein a buffer material capable of allowing air to flow therethrough such as a sponge or a cotton.

In an embodiment, the waist belt 42, the right shoulder belt 44, the left shoulder belt 46, the right back pad 48, and the left back pad 50 may be integrated.

In an embodiment, the cooling structure 56 may comprise only the shoulder cooling fans 70 or only the waist cooling fans 72. Further, the cooling structure 56 may comprise only one shoulder cooling fan 70 and/or only one waist cooling fan 72.

In an embodiment, the cooling fans 58 may be disposed at the cooling ports 60.

In an embodiment, the backpack-type assembly 2 may not comprise the attachment 52. In this case, the external power supply 62 may be detachably attached to the waist belt 42 by a buckle, and may be detachably attached to the shoulder belt(s) 38 by buckle(s).

In an embodiment, the flow rate adjusting switch 66 may be configured with a rhythmic operation mode configured to automatically switch between the HIGH mode and the LOW mode.

In an embodiment, the plurality of cooling ports 60 may comprise only the one or more shoulder cooling ports 76, the one or more back cooling ports 78, or the one or more waist cooling ports 80, or only a combination of two of the aforementioned ports.

In an embodiment, the body 4 may supply electrical power to the cooling fans 58 through an adapter such as cables.

In an embodiment, the shifter switch 64 and the flow rate adjusting switch 66 may be disposed on one or more of the cooling fans 58.

What is claimed is:

1. A backpack-type assembly comprising:

a body; and a base member including a first shoulder cooling port, wherein the base member comprises:

a back plate attached to the body; and a harness attached to the back plate and configured to be worn on a user, the harness comprises:

at least one shoulder belt configured to be worn on a shoulder of the user; and a shoulder cooling fan, the at least one shoulder belt comprises:

a contact surface configured to contact the shoulder of the user;

a non-contacting surface being a surface on an opposite side from the contact surface and configured to not contact the shoulder of the user; and a shoulder air passage defined inside the at least one shoulder belt and communicating with the first shoulder cooling port, the first shoulder cooling port is disposed on the contact surface, the shoulder cooling fan is disposed on the non-contacting surface, and the shoulder cooling fan is configured to operate such that, cooling air flows into the shoulder air passage from outside of the at least one shoulder belt through the shoulder cooling fan and flows out, to the outside, of the at least one shoulder belt through the first shoulder cooling port, or cooling air flows into the shoulder air passage through the first shoulder cooling port and flows out, to the outside, of the at least one shoulder belt through the shoulder cooling fan.

2. The backpack-type assembly according to claim 1, wherein the first shoulder cooling port is disposed in the vicinity of the user when the user wears the harness.

3. The backpack-type assembly according to claim 1, wherein the first shoulder cooling port faces the user when the user wears the harness.

4. The backpack-type assembly according to claim 1, wherein the harness further comprises a back pad configured to be in contact with a back of the user when the user wears the harness, the back pad includes a back cooling port, and the back cooling port faces a portion of the back of the user being in contact with the back pad when the user wears the harness.

5. The backpack-type assembly according to claim 1, wherein the harness further comprises a back pad configured to be in contact with a back of the user when the user wears the harness, the back pad includes a back cooling port, a non-contacting space is defined between the back of the user and the back plate when the user wears the harness, the non-contacting space being a space in which the back pad is not disposed, and the back cooling port faces the non-contacting space when the user wears the harness.

6. The backpack-type assembly according to claim 1, wherein the harness further comprises a waist belt configured to be worn on a waist of the user, and the waist belt includes a waist cooling port.

7. The backpack-type assembly according to claim 6, wherein the harness further comprises a waist cooling fan disposed on the waist belt, and the waist cooling fan is configured to circulate cooling air into or out of the base member through the waist cooling port.

8. The backpack-type assembly according to claim 1, wherein the base member further comprises a back plate-side cooling fan disposed on the back plate.

9. The backpack-type assembly according to claim 1, further comprising an external power supply configured to supply electrical power to the shoulder cooling fan.

10. The backpack-type assembly according to claim 9, wherein the base member comprises an attachment configured to detachably attach the external power supply thereto.

11. The backpack-type assembly according to claim 1, wherein the body is configured to be electrically connected to the shoulder cooling fan and is configured to supply electrical power to the shoulder cooling fan.

12. The backpack-type assembly according to claim 1, wherein the shoulder cooling fan is configured so that a flow rate of the shoulder cooling fan is adjustable.

13. The backpack-type assembly according to claim 1, wherein the body is configured to be connected to an electrical working machine comprising a motor, and the body is configured to supply electrical power to the motor of the electrical working machine.

14. The backpack-type assembly according to claim 1, wherein the at least one shoulder belt includes a second shoulder cooling port communicating with the shoulder air passage and disposed in a vicinity of a boundary between the contact surface and the non-contacting surface.

15. The backpack-type assembly according to claim 1, wherein a width of the shoulder cooling fan is equal to or less than 50% of a belt width of the at least one shoulder belt.

16. The backpack-type assembly according to claim 1, wherein the harness further comprises:

a waist belt configured to be worn on a waist of the user;

a first waist cooling fan disposed on one end of the waist belt in a longitudinal direction of the waist belt; and a second waist cooling fan disposed on another end of the waist belt in the longitudinal direction.

17. A backpack-type assembly comprising:

a body; and a base member including a shoulder cooling port, wherein the base member comprises:

a back plate attached to the body; and a harness attached to the back plate and configured to be worn on a user, the harness comprises:

at least one shoulder belt configured to be worn on a shoulder of the user; and a cooling fan, the at least one shoulder belt comprises:

a contact surface configured to contact the shoulder of the user;

a non-contacting surface being a surface on an opposite side from the contact surface and configured not to contact the shoulder of the user; and a shoulder air passage defined inside the at least one shoulder belt and communicating with the shoulder cooling port, the shoulder cooling port communicates with the shoulder air passage and is disposed in a vicinity of a boundary between the contact surface and the non-contacting surface, and the cooling fan is configured to operate such that, cooling air flows out, to outside of the at least one shoulder belt, through the shoulder cooling port, or cooling air flows into the shoulder air passage through the shoulder cooling port.

* * * * *